US007546749B1

(12) United States Patent
Biren

(10) Patent No.: US 7,546,749 B1
(45) Date of Patent: Jun. 16, 2009

(54) JEWELRY ARTICLE UTILIZING A LINEAR STONE SETTING

(76) Inventor: Richard Warren Biren, 9503 Beverlywood St., Los Angeles, CA (US) 90034

( * ) Notice: Subject to any disclaimer, the term of this patent is extended or adjusted under 35 U.S.C. 154(b) by 294 days.

(21) Appl. No.: 11/418,189

(22) Filed: May 5, 2006

(51) Int. Cl.
*A44C 9/00* (2006.01)

(52) U.S. Cl. ..... 63/15; 63/3; 63/28; D11/34

(58) Field of Classification Search ..... None
See application file for complete search history.

(56) References Cited

U.S. PATENT DOCUMENTS

| | | | | |
|---|---|---|---|---|
| 5,437,167 | A | 8/1995 | Ambar | |
| 5,765,398 | A | 6/1998 | Bardisbanyan | |
| 6,067,818 | A | 5/2000 | Winkler | |
| 6,125,516 | A | 10/2000 | Winkler | |
| 6,298,689 | B1 * | 10/2001 | Lai | 63/26 |
| 6,318,121 | B1 | 11/2001 | Pachauer | |
| 6,591,633 | B2 | 7/2003 | Pachauer | |
| D480,659 | S | 10/2003 | Pachauer | |
| 6,634,184 | B2 | 10/2003 | Feldman | |
| D482,636 | S | 11/2003 | Pachauer | |
| D483,685 | S | 12/2003 | Pachauer | |

* cited by examiner

*Primary Examiner*—Jack W. Lavinder
(74) *Attorney, Agent, or Firm*—Jones, Tullar & Cooper, P.C.

(57) ABSTRACT

An article of jewelry supports a plurality of primary stones in a linear mounting array and which is bordered on both sides by accent stones. The girdles of the primary stones and of the accent stones are positioned close to each other with the accent stone girdles being above the primary stone girdles. A method of making the article of jewelry includes the use of a lost wax casting process followed by hand-setting of the accent stones and an application of a highly reflective coating, such as rhodium to surfaces that are adjacent the areas of congruence of the primary and accent stones. The resultant piece of jewelry presents the appearance of floating or unsupported primary stones.

20 Claims, 3 Drawing Sheets

JEWELRY ARTICLE UTILIZING A LINEAR STONE SETTING

FIELD OF THE INVENTION

The present invention is directed generally to an article of jewelry that utilizes a linear setting of a plurality of stones. More particularly, the present invention is directed to a jewelry article and to a method of making a jewelry article which includes a plurality of gemstones in a linear setting. Most specifically, the present invention is directed to a jewelry article that includes linearly mounted primary gemstones and flanking, accent or trim stones. The primary stones are situated in a linear array in a segmented slot in the article of jewelry and the trim or accent stones are hand-set in a complementary arrangement. The primary stones in the article of jewelry have the appearance of being unsupported or of floating.

BACKGROUND OF THE INVENTION

In articles of jewelry, such as pendants, earrings, bracelets, necklaces, rings and bands, the mounting of gemstones, such as diamonds and other stones, may be accomplished in a variety of ways. The more conventional of these various mounting configurations is through the use of prongs or prong settings. Channel settings are also often used, typically to mount a plurality of stones adjacent each other in a line or a row. Invisible mounting is another generally known type of mounting and is often used in an effort to create the appearance that the stone is not supported in its mounting. Each of these generally known mounting procedures is quite conventional in the jewelry industry and while each has it attributes, each also has its limitations.

In a prong setting, each gemstone, typically a diamond, having any one of a number of shapes, is held in a setting which includes a plurality of spaced, upstanding prongs or fingers. Since most gemstones have an upper, faceted crown, a central girdle and a lower pavilion, the prongs or fingers of the typical prong setting must be made to engage at least the lower portion of the crown, generally above the girdle, and the upper portion of the pavilion, as well as the girdle in order to securely hold the stone in the setting. Although there are many variations on this prong mounting or setting structure, the essential characteristic of all such prong settings is the engagement of a part of the stone's crown, pavilion and girdle with a plurality of spaced metal prongs or fingers.

Such prong settings have several limitations. The first is that a portion of at least one facet of the stone's crown is obstructed by the prongs which engage it. Such an obstruction reduces the visual impact of the stone. Since there must be provided a plurality of such prongs in a prong setting, portions of a plurality of the facets of the stone are obstructed. The brilliance, scintillation or color dispersion of a stone is, at least in part, a function of its faceting. When one or more facets are obstructed, the result is a reduction in the set stone's apparent brilliance.

Another limitation of prong settings is their propensity to loosen. Since an effort is made to keep the prongs as visually unobtrusive as possible, these prongs may not have the structural rigidity that is essential to retain the stone in the setting. The result is the possible loss of the stone. The resulting loss of a valuable gemstone, because of the failure of a prong setting to securely hold the stone, is not an acceptable occurrence. A compromise must thus be made between secure stone support and loss of stone brilliance.

Prong settings are also prone to catch on articles of clothing. Again, since each prong in the setting includes a free end or edge, that has to project above the stone's girdle and which is essentially deformed to hold the stone in the setting, there will inevitably be a prong tip or a point that can become caught in the fabric of gloves, clothing and the like. Such an occurrence is an inconvenience and may also result in damage to the clothing.

In an effort to alleviate the drawbacks of conventional prong settings, the jewelry industry has turned to the use of channel settings. In such channel settings, which are more frequently used to hold a grouping of stones, and which are most specifically utilized to set a row of stones, the article of jewelry is provided with a channel or groove. The pavilion of the stone will be positioned within the confines of the channel. The girdle of the stone will also be situated within the channel and adjacent, but beneath the channel's upper rim. That upper rim of the channel will then be deformed slightly inwardly to engage the crown of the stone, just above the girdle.

Channel settings are not subject to several of the problems inherent with prong settings. They typically do not loosen and they do not catch in clothing. However, a significant limitation of such a channel setting is that the bulk of the stone is located within the channel and is below the level of the top surface of the piece of jewelry. The placement of the stones in such a channel setting thus significantly limits the brilliance or scintillation that the stones in the resultant piece of jewelry are able to provide. Placement of the stones in such a channel effectively submerses them within the article of jewelry.

In an effort to overcome the limitations of channel settings, without also incurring the drawbacks of prong settings, the jewelry industry often utilizes invisible settings. These settings, as their name implies, are attempts to make the setting invisible so that the stone or stones will appear to be unsupported. In an invisible setting, each stone has a groove or slot cut into its girdle. A piece of wire or a thin band is positioned in the article of jewelry and is located so that it will be received in the girdle slot of each stone that is to be held in the mounting. If several rows of stones are to be placed side by side, there need be provided a grid arrangement of thin wires or bands, all of which must be placed in the grooves which have been cut into the girdles of all of the stones intended to be held by such an invisible mounting.

No setting can be truly invisible, and since all settings must retain the stone or stones in place, invisible settings typically at least partially cover the faceted crown and the table of the gemstones and particularly the ones of the stones which border the edges of the channel or recess that provides a location for the wires or bands which fit into the grooved girdles. The girdles and crowns of the peripheral stones then engage the walls of the channel, which walls, at least partially overlap the crown facets and reduce the brilliance of the stones. Such invisible mountings do not completely overcome the limitations of channel mountings and still compromise the brilliance and sparkle of the mounted gemstones.

Invisible settings are notoriously insecure. The very nature of the use of a small groove in a stone's girdle, and the placement of a fine wire into the groove, is one that makes invisible settings delicate. Also, since the thin wires or bands which are used to hold the stones, are easily bent or broken, the piece of jewelry, which is typically a ring, cannot be easily sized. Changing the ring size of the piece of jewelry, even within reasonable ranges, is apt to either loosen or to break the wires or bands, with a resultant loss of the retained gemstones.

It is apparent that a need still exists for a jewelry mounting that provides for the mounting of the gemstones in a manner in which they appear to be unsupported or floating, while not compromising their brilliance and scintillation or color dispersion. At the same time, the mounting must overcome the limitations of the prior art and must be able to hold the article's gemstones securely. The jewelry article with linear stone settings, in accordance with the present invention, provides such a mounting. It is a substantial advance over the prior art.

SUMMARY OF THE INVENTION

It is an object of the present invention to provide a jewelry article with a linear mounting of a plurality of primary stones.

Another object of the present invention is to provide a linear jewelry mounting method which supports a linear array of gemstones that appear to be unsupported or floating.

A further object of the present invention is to provide a linear jewelry mounting in which primary, linearly mounted gemstones which appear to be unsupported, are bounded by trim or accent stones.

Yet another object of the present invention is to provide a linear mounted jewelry article in which the linear array of primary gemstones appear to have no gaps between adjacent ones of those gemstones.

Still a further object of the present invention is to provide a jewelry article having gemstones that are not overlapping.

As will be described in detail in the description of the preferred embodiment which is set forth subsequently, the jewelry articles utilizing linear mountings of linear arrays of stones, including primary stones and flanking accent or trim stones in accordance with the present invention, utilize a lost wax casting or investment casting technique of manufacture to secure a linear array of primary gemstones in a linear setting array which support the primary stones in the jewelry article while providing an appearance that the primary stones are not supported. The jewelry article is also formed having a plurality of upright ports or projections, which posts are used to position, support and to retain trim or accent stones that flank both sides of the primary stones. These trim or accent stones are hand-set after the jewelry article, with the primary stones in place, has been cast. The trim or accent stones are held by these posts or projections with portions of their pavilions overlying, to a very slight degree, portions of the crowns of the primary stones and are used to minimize and to hide the very small arcuate gaps which exist between adjacent ones of the primary stones. Once the jewelry article, with the primary and accent stones in place, has been made, the piece is highly polished and is subjected to a coating step. A thin layer of rhodium or a similar material is applied to the area of the article which supports the stones. This coating effectively eliminates the appearance of spaces between the girdles of adjacent stones. The trim or accent stones do not physically contact the primary stones which are held at their girdles in the linear array. The result is an article of jewelry in which the primary stones, and to some extent the accent stones, appear to be unsupported to a much greater degree than has been accomplished in the prior articles.

The trim or accent stones are set between posts which are provided with bearings, in the form of grooves or slots and into which only a portion of the girdle of each stone is placed. The majority of the girdle and crown of each such accent or trim stone is free of post contact. The posts themselves are not bent or deformed to hold these accent or trim stones in place. They thus do not significantly obstruct the crown facets of the accent or trim stones. The posts however are sufficiently robust that they will securely support the accent or trim stones and will not be susceptible to loosening so that the trim or accent stones will not fall out of the setting. These posts also are formed with smooth, rounded tops so they are not a snagging hazard as are more conventional prongs.

The primary stones are held in their linear mounting array in separate apertures which combine to form a segmented slot in the article of jewelry. Only portions of the girdles of these primary stones, which are adjacent the bordering trim stones and posts, are in engagement with aperture walls in the segmented slot. In typical channel settings, the somewhat triangular gaps which exist between adjacent channel stones, are partly covered by deformation of the channel rims inwardly. In the present invention, these triangular gaps between the outer edges of adjacent ones of the primary stones are made to appear less apparent by the use of a rhodium coating in the segmented slot, and by the placement of the crowns and tables of the trim or accent stones in these gaps which exist between the outer edges of adjacent ones of the primary stones. These accent or trim stones thereby essentially fill the small primary stone gaps which would otherwise be slightly visible. The result is an article of jewelry in which the floating or unsupported appearance of the primary stones is maximized.

In marked contrast to generally known invisible mountings, the jewelry articles of the present invention do not utilize a network of thin wires or bands as a mechanism for holding the primary stones in place. The pavilions of the trim or accent stones do not physically contact the crown facets of the primary stones. As a result, all of the stones are better able to provide their characteristic brilliance, scintillation or color dispersion. The jewelry articles of the present invention thus provide a much greater perception of an unsupported or floating mounting of the primary gemstones than has been possible by utilization of the generally known, prior mounting techniques and devices.

The jewelry article with linear mountings, and its method of making, in accordance with the present invention, overcomes the limitations of the prior devices and methods. It is a significant advance in the art.

BRIEF DESCRIPTION OF THE DRAWINGS

While the novel features of the jewelry article with linear primary stone mountings, in accordance with the present invention, are set forth in the appended claims, a full and complete understanding of the invention may be had by referring to the detailed description of the preferred embodiment, as set forth subsequently, and as is shown in the accompanying drawings, in which:

DESCRIPTION OF THE PREFERRED EMBODIMENT

Figure 1:
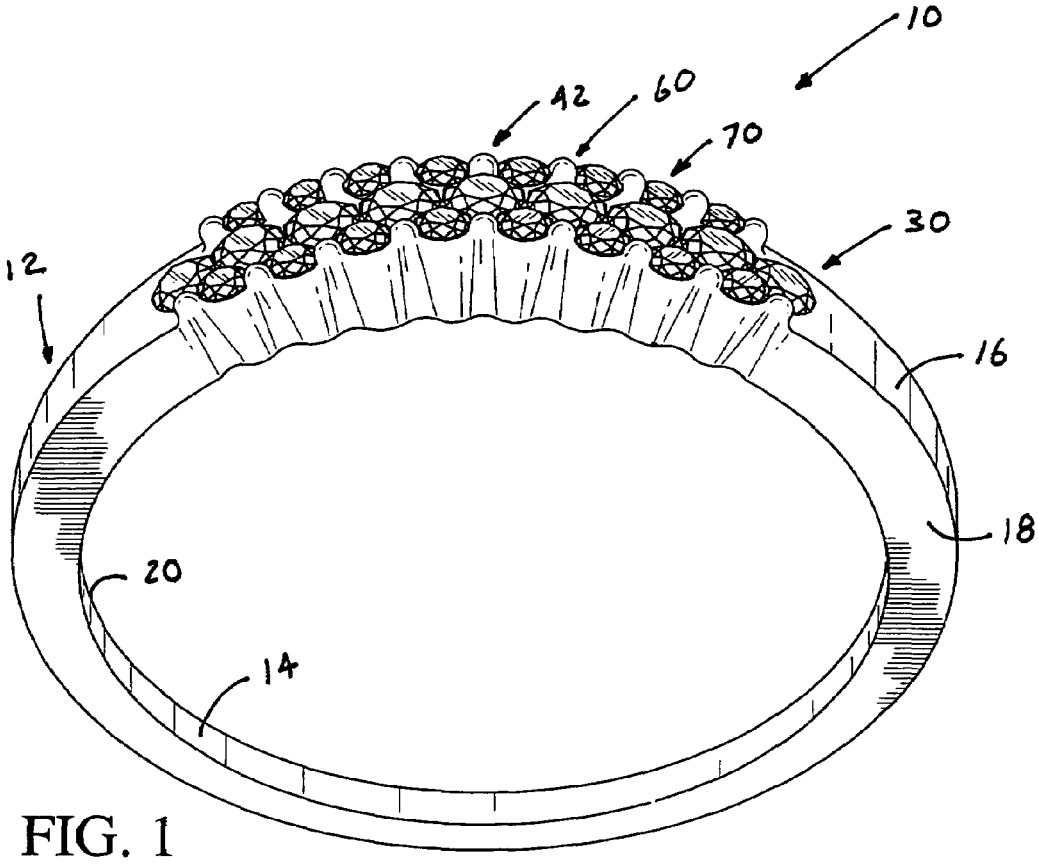
FIG. 1 is a perspective view of a ring in accordance with the present invention.

Referring initially to FIG. 1, there may be seen generally at 10 a ring in accordance with the present invention. Ring 10, as depicted in FIG. 1, and as described hereinafter, is intended to be exemplary of a number of articles of jewelry which can be made in accordance with the present invention. While the following discussion and description will be presented in the context of its use with the ring 10 shown in FIG. 1, it will be understood that the invention is not to be limited to its use with a ring or a bracelet or an earring or a pendant or any other specific piece of jewelry. The depiction of a ring as one embodiment of the invention is for the purpose of depicting one article of jewelry that can utilize the subject invention which, in the broader scope, is directed to the provision of a variety of articles of jewelry in which a primary center row of stones are arranged in a linear setting and are bordered by flanking accent or trim stones. The structure and method of mounting of the stones makes it appear as if the primary stones are unsupported or are floating.

Figure 4:
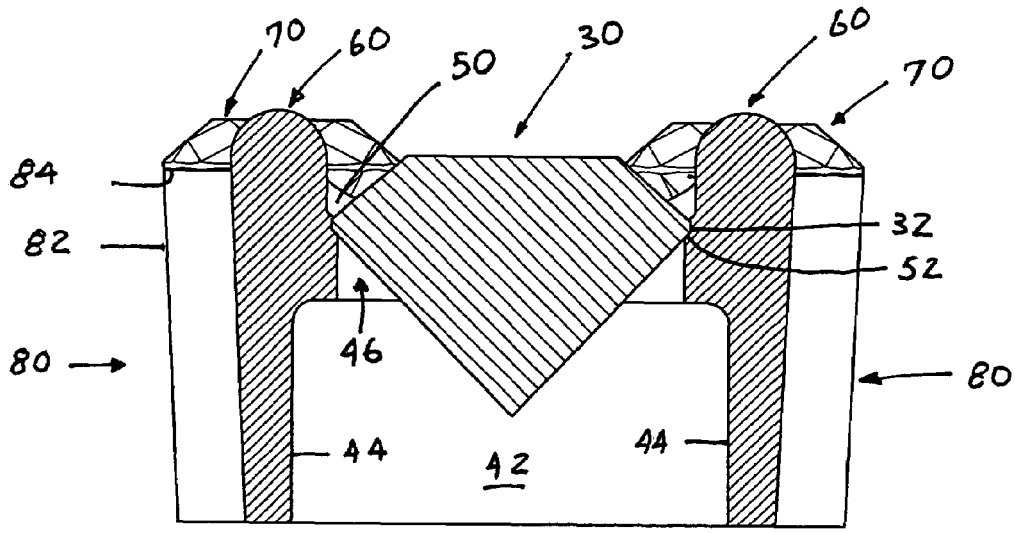
FIG. 4 is a transverse cross-sectional view of the ring taken along line 4-4 of FIG. 2.

Referring again initially to FIG. 1, the ring, generally at 10, includes a generally annular band 12 which includes a band inner surface 14, a band outer surface 16 and spaced band side walls 18 and 20. The band 12 may be made using any material which is suitable for such applications, typically yellow or white gold, platinum or the like. A group of primary, recessed stones, each generally at 30, are set in a linear setting, in a segmented slot, as may be seen, generally at 42, which segmented slot 42 is also seen in FIGS. 1 and 4-7, by the utilization of a process which will be described in detail shortly. The primary stones 30, which are arranged in a linear setting, and which are somewhat recessed in the annular band 12, are the primary, central or predominant stones in the depicted jewelry article, such as ring 10. Each of the primary stones 30 is depicted as a round stone which is provided with a girdle 32, a pavilion 34, a crown 38 and a table 40, as seen in FIGS. 4 and 6. These stones, which are typically precious gemstones, are positionable in a linear setting or a linear mounting, in accordance with the present invention, to form a number of articles of jewelry, such as the ring 10 depicted in FIG. 1.

Figure 6:
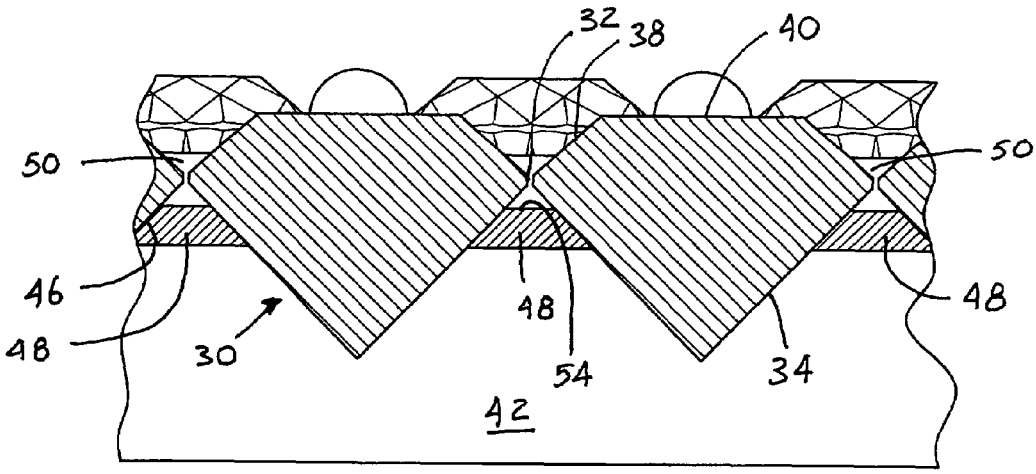
FIG. 6 is a longitudinal cross-sectional view of the ring taken along line 6-6 of FIG. 2.
Figure 7:
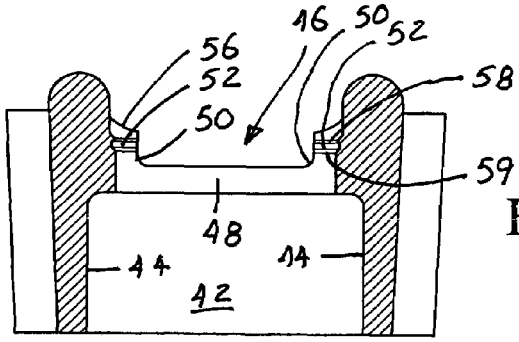
FIG. 7 is a cross-sectional view essentially the same as FIG. 4 and with the gemstones removed.
Figure 8:
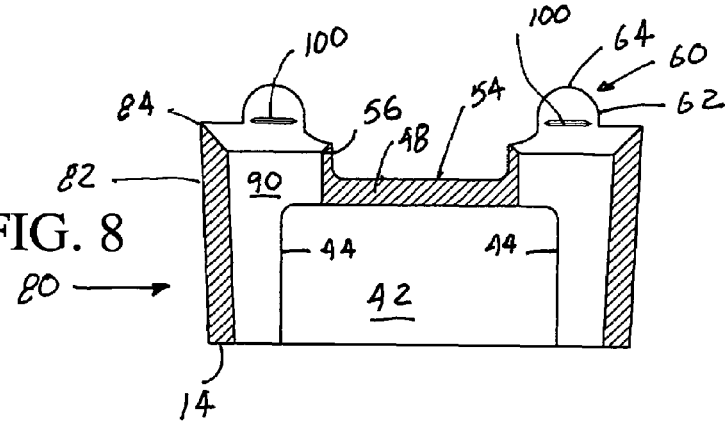
FIG. 8 is a cross-sectional view similar to FIG. 5 again with the gemstones removed.

Again, as may be seen generally in FIG. 1, and as is shown more clearly in FIGS. 4 and 6, the segmented slot 42 in which the linear mounting of the plurality of primary stones 30 are set extends generally circumferentially for a defined length of the ring 10 with the tables of the primary stones 30 being above at the level of the outer surface 16 of the ring's band 12. Segmented slot, generally at 42, includes spaced vertically extending slot sidewalls 44, a plurality of slot apertures 46, as seen in FIG. 7, and a plurality of slot webs 48, as seen in FIG. 8. As may be seen in FIG. 6, the slot apertures 46 and the slot webs 48 are sequentially spaced in the circumferential direction of the annular band 12. Each primary stone 30 is placed with a portion of its pavilion being positioned in one of the slot apertures 46, whose shape is complementary to the shape of the pavilion 34 of the stone 30. Each aperture 46 is defined by generally arcuate aperture wall sections 50 which, as seen in FIG. 6, are discontinuous. These aperture wall sections 50 do not extend transversely to the annular band 12 and do not overlie the slot webs 48. Each such aperture wall section 50 is thus only a portion of a circle. Each aperture wall section 50 engages a section of its primary stones's girdle 32 during the lost wax or the investment casting process which is used to form each article of jewelry, as will be discussed subsequently. In the depiction of FIG. 7, in which the primary stone 30 has been removed, for purposes of illustration, it will be seen that the aperture wall segment 50, as they are formed, during the casting of the ring 10, with the primary stones in place, include grooves 52 that correspond, in shape, to the girdles 32 of the primary stones which form the grooves 52 during the article of jewelry fabrication process. Support of the primary stones 30 is accomplished by these grooves 52 in the aperture wall segments 50.

Figure 5:
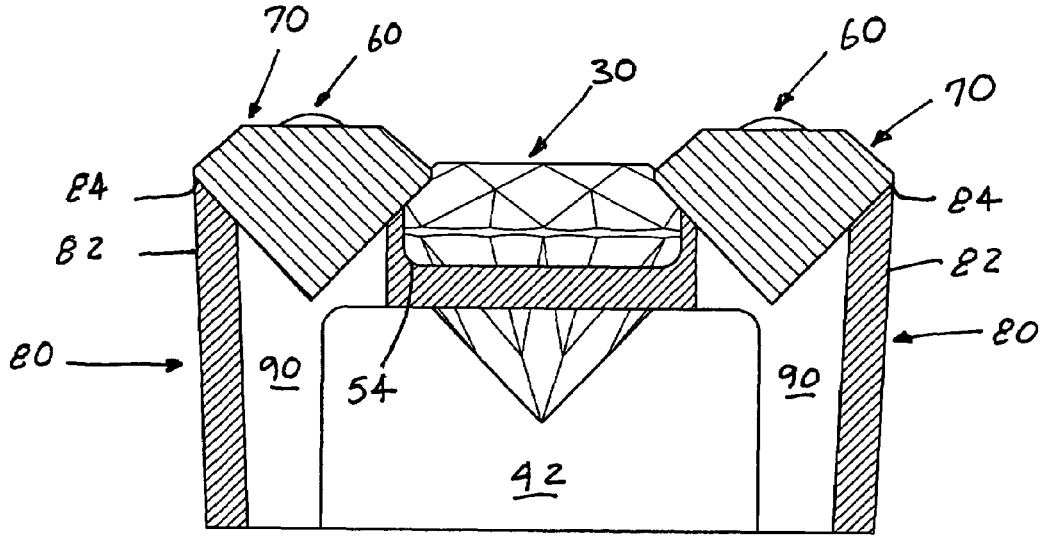
FIG. 5 is a transverse cross-sectional view of the ring taken along line 5-5 of FIG. 2.

By referring to FIGS. 5 and 7, it will be readily apparent that the aperture wall sections or segments 50 are discontinuous and do not overlie the slot webs 48. These slot webs 48, as can be seen in FIGS. 4, 5, 7 and 8 are somewhat hourglass-shaped in plan view. The slot apertures 46 which they define to not closely engage each primary stone's entire pavilion 34, with a substantial portion of each such primary stone pavilion 34, as seen in FIG. 5, being not bordered by the adjacent slot webs 48. Each such slot web 48 is situated so that all of the crown 38, the girdle 32 and a portion of the pavilion 34 of each one of the primary stones 30 will be above an upper surface 54 of each slot web 48. As seen in FIG. 7, the arcuate aperture wall segment grooves 52 are also above the upper surfaces 54 of the slot webs 48. The aperture wall segment grooves 52 are however situated beneath aperture wall segment upper edges 56, again as may be seen in FIGS. 7 and 8.

A plurality of spaced posts generally at 60 extend radially outwardly or upwardly above the slot sidewalls 44 and the aperture wall segments 50. These posts 60, which are generally cylindrical, extend slightly beyond the outer surface 16 of the ring band 12. These posts 60 are symmetrical with respect to a circumferentially extending center line of the segmented slot 42. The posts 60 are placed on opposing sides of the band outer surface 16 and are centered on transverse center lines, which are not specifically shown, of the slot apertures, which center lines extend generally perpendicularly to the channel circumferential center line. Each post 60 is generally cylindrical and includes a post sidewall 62 and a rounded post top 64. As seen in FIGS. 5, 7 and 8, the posts 60 are part of the band 12 and project slightly out beyond the outer surface 16 of the body of the band 12 of the ring 10.

A group of accent or trim stones, generally at 70, are placed in a pair of circumferentially spaced linear arrays along both sides of the ring band outer surface 16 and are aligned on both sides of the linear setting of primary stones 30. These accent or trim stones 70 are typically the same overall shape as the primary stones 30 but typically are of reduced diameter, with respect to the primary stones 30. As depicted in the present embodiment of the subject invention, the accent or trim stones 70 are approximately ⅔ to ¾ of the diameter of the primary stones 30. For example, with primary stones 30 of a girdle diameter of generally 1.5 mm, the accent or trim stones 70 have a girdle diameter of generally 1.1 mm. If the primary stones 30 have a girdle diameter of generally 2 mm, the girdle diameters of the accent or trim stones 70 may be approximately 1.6 mm.

The body of the ring band 12, intermediate the plurality of posts 60, is structured generally as a cylindrical group of circumferential spaced sleeves 80 which end at the outer surface 16 of the band. Each cylindrical sleeve, generally at 80 includes, as seen in the most clarity in FIG. 8 has an outer sleeve wall 82 which terminates in an outer sleeve wall upper edge 84. This outer sleeve wall 82 defines a portion of the respective band sidewall 18 or 20. The outer sleeve wall upper edge 84 of each cylindrical sleeve 80 cooperates with the upper edge 56 of each of the aperture wall segments 50 to define an accent or trim stone receiving socket, generally at 90. Each such socket 90 is also generally cylindrical and extends from the band outer surface 16 toward the band inner surface 14. Each such socket, generally at 90, thus does not support, or engage the girdle of the associated trim or accent stone 70. The socket does engage a small portion of each accent or trim stone's pavilion. However, the width of the aperture wall top edge 56 and that of the web sleeve wall upper edge 84 are kept as thin as possible, consistent with manufacturing criteria, so that the brilliance of each trim or accent stone will not be diminished.

As may be seen most clearly in FIGS. 1, 3, 5 and 8, each of the cylindrical sleeves 80 includes the outer cylindrical sleeve wall 82 that extends out of the plane defined by the otherwise generally planar sides 16 and 18 of the band 12 of ring 10. Each such cylindrical sleeve outer wall 82, which terminates at its outer or upper edge 84 forms an arcuate trim or accent stone girdle engaging bumper or lip 84. As seen most clearly in FIG. 5, that lip or bumper 84 underlies the exteriorly located portion of the girdle of each of the accent or trim stones 70 and protects its associated accent or trim stone 70 from accidental dislodgement.

Figure 2:
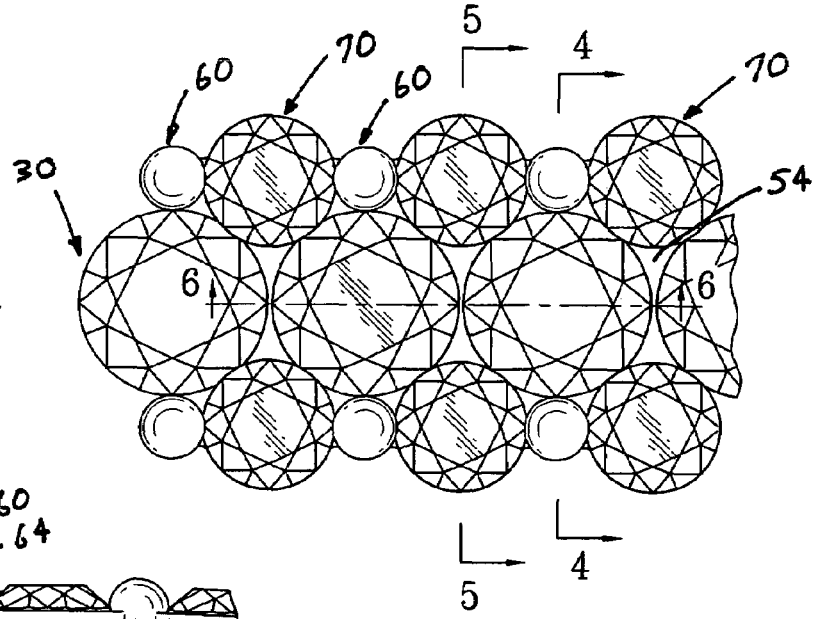
FIG. 2 is a top plan view of a portion of the ring depicted in FIG. 1.
Figure 3:
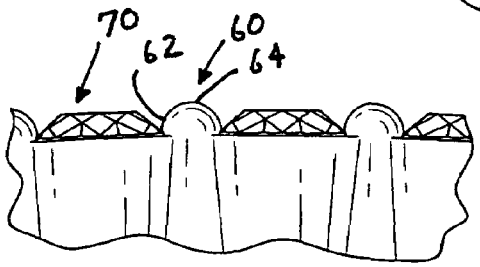
FIG. 3 is a side elevation view of the portion of the ring shown in the top plan view of FIG. 2.

A post bearing surface or bearing 100 is provided in the sidewall 62 of each post 60, at a level slightly above that of the lip or bumper 84 of the cylindrical sleeve outer wall 80. These post bearing surfaces 100 are cut into their respective posts 60 after the ring 10 has been made and before the accent or trim stones 70 are set in place. Each such post bearing surface 100 engages the girdle of the accent stone 70 which is supported in the accent stone socket 90 that is located between the adjacent posts 60 along either side of the outer surface 16 of the band 12 and on both sides of the band's central slot 42. These post bearings 100, complement the lip or bumper 84 of each accent stone receiving band socket 90 and retain each of the accent or trim stones 70 in its respective sockets 90. As may be seen most clearly in FIG. 3, the tables of the accent or trim stones 70 are situated slightly beneath or radially inwardly of the tops 64 of the posts 60. This positioning of the accent or trim stones 70 protects them from damage. The inner aperture wall top 56 of each accent or trim stone socket 90, as seen in FIGS. 5 and 8, is of reduced height, when compared to the height of the outer sleeve wall upper edge 84 of each such socket. The accent or trim stones 70 are positioned in their respective sockets 90 in a manner, as depicted in FIGS. 2 and 4-6 so that the girdle of each accent stone 70 is above the girdle 32 of each adjacent primary stone 30. The pavilions of the accent stones 70 do not physically contact the crowns 38 of the primary stones 30. The intent of the slight overlap, as may be seen in FIG. 2, is to further reduce any portion of the top surface 54 of the slot web 48 that may be visible. As seen in FIGS. 2 and 6, the girdles 32 of adjacent ones of primary stones 30 are placed together as closely as possible, again to minimize the size of the small, generally triangular portions of the slot web upper surfaces 54 which can been seen. Each primary stone 30 is thus able to appear essentially unsupported, or floating, in the linear setting in accordance with the present invention.

Referring now primarily to FIGS. 4 and 6, it will be seen that each of the primary stones 30, which together constitute the linear setting or mounting of the present invention is retained in the slot 42 by engagement of each primary stone's girdle by the two opposing aperture wall segment grooves 52 which border only a portion of each such primary stone 30 as it is positioned in the linear setting in the segmented slot 42. When each item of jewelry, such as the ring 10, is made, in a manner that will be discussed in greater detail subsequently, each primary stone 30 is retained in the linear setting or mounting by the metal, such as gold or platinum which will form the item of jewelry. That metal is formed around a portion of the girdle 32 of each primary stone during the lost wax or investment casting process it. The arcuate aperture wall segments 50 have a spacing, with respect to the opposing segments 50 which is slightly less than the girdle diameter of each primary stone 30 that is supported in the segment slot 42. The groove 52 in the arcuate aperture wall segment 50 defines upper and lower lips 58 and 59 which lips 58 and 59 slightly overlies the pavilion 34 and crown 38, respectively, of each primary stone 30, directly above and below the girdle 32. This is the result of the process used to form the article of jewelry, as will be discussed shortly. It is these lips 58 and 59 which retains the primary stones 30 in their linear mounting in the slot 42 of the article of jewelry, such as the ring 10 described above.

The top plan view of the article of jewelry, such as the ring 10 made in accordance with the present invention, as seen in FIG. 2, shows that the entire table 40, and the preponderance of the crown 38 of each of the primary stones 30 and of each of the accent or trim stones 70 is visually unobstructed. Typically, approximately 95% of each primary stone crown 38 is exposed. In addition, a portion of the girdle 32 of each primary stone 30, and all of the table of each primary stone and of each accent or trim stone 70, is also unobstructed. The girdles of the adjacent primary stones 30, and of their flanking accent or trim stones 70 do not physically contact each other. The spacings between them is kept at a minimum consistent with manufacturing tolerances. The structure of the item of jewelry and particularly the support of the primary stones only by the lips 58 and 59 of the aperture wall segments 50 give the appearance of freely suspended or floating primary stones in the linear setting in accordance with the present invention.

The items of jewelry in accordance with the present invention are preferably made using the lost wax or investment casting process. A wax positive of the band 12 of the ring 10 is made using a rubber negative. Once the wax band has been made, the primary stones 30 are placed in the band in their linear setting array. The accent or channel stone receiving sockets 90 are also formed but are left empty at this stage of the manufacturing process. The wax positive of the intended item of jewelry is surrounded by an investment material, which may be sand or Plaster of Paris and which is sprued so that molten metal, such as gold or platinum, can be poured in. As is known to one of skill in the art, as the molten metal is poured into the mold, it takes the place of the wax, which melts and exits the mold through one of the exit passageways.

Once the casting has been cooled, and the investment material has been removed, the article of jewelry is polished by a jeweler as a first step in making of the finished article. The metal is polished to a high polish in a generally known manner.

Each article of jewelry, which has now been polished, is placed in a deformable fixture or jig which is a negative of the corresponding article of jewelry. The not yet fully completed piece of jewelry, which has been placed in this deformable fixture or jig, which may be wood or hard rubber or a similar material, is subjected to a tightening by the application of a compressive force to the exterior of the jig or fixture. This compressive force can be applied by hand through the use of suitable clamps, typically by a jeweler. This tightening insures that the lips 58 and 59 on the arcuate aperture wall segment grooves are in firm engagement with the girdles of the respective primary stones 30 so that the primary stones 30 are held securely in their linear setting in the segmented slot 42 of the band of the article of jewelry. This tightening provides further assurance that the stones, which appear to be freely floating, are actually securely held in the article of jewelry and cannot be readily dislodged.

The article of jewelry, such as the ring 10 depicted in FIG. 1, is then given to a hand setter who cuts the post bearing surfaces 100 into the post sidewalls 52 of the posts 60 and who then places the accent or trim stones 70 in their respective sockets 90. The posts may deform slightly to receive the girdle of each accent or trim stone 70 in its associated post bearings 100 and will then return, or be returned, to a position that holds the accent or trim stones 70 in place.

A plating or coating of rhodium or a similar high gloss finish metal is now applied to the visible portions of the segmented slot 40 and specifically to the upper surfaces 54 of the slot web 48. The rhodium coating is preferably added to all of the exposed surfaces next to the gemstones. This coating acts to enhance the reflectivity of the surfaces on which it is placed so that the gemstone's facets will be reflected off the rhodium coated surfaces. While rhodium is the preferred coating metal, other processes and materials can be used to render the channel more reflective. Once this plating or coating has been applied, the now completed article of jewelry can undergo one final polishing step, if needed, to remove any minor irregularities or scratches incurred during the setting of the accent stones or the plating process.

The jewelry article utilizing a linear setting of primary stones, with flanking linear settings of accent or trim stones, in accordance with the present invention, is superior in both appearance and durability to the prior articles. Once the jewelry article has been tightened, has had the accent stones set in place, and has been plated and fully polished, the linear setting of the primary stones truly appears to be unsupported or to be floating. The article of jewelry does not exhibit any of the propensity toward loosening of the stones which have characterized prior settings. If the article of jewelry is a ring, that ring can be sized, within usual ranges, without any reduction of the linear setting integrity. The jewelry article of the present invention thus provides the appearance of unsupported gemstones, that is an attribute of invisible settings, while also providing the durability of channel or prong settings.

While a preferred embodiment of an article of jewelry, and its method of manufacture, in accordance with the present invention, have been set forth fully and completely hereinabove, it will be apparent to one of skill in the art that various changes in, for example, the overall shape of the article of jewelry, the type, size and number of stones used in the article of jewelry, the specific material used to make the article of jewelry and the like could be made without departing from the true spirit and scope of the present invention which is accordingly to be limited only by the appended claims.

What is claimed is:

1. An article of jewelry comprising:

a jewelry article body;

a segmented slot formed in said body and including spaced slot apertures, including aperture wall segments, and slot webs;

a plurality of spaced posts bounding said segmented slot and extending above said slot aperture wall segments;

a plurality of primary stones positioned in said segmented slot in a linear setting;

a plurality of accent stone receiving sockets in said body intermediate said posts; and an accent stone in each said accent stone receiving socket and in engagement with said one of said spaced posts bounding each said accent socket, each said primary stone and each said accent stone having a girdle and a crown and wherein said primary stone girdles are situated beneath said accent stone girdles.

2. The article of jewelry of claim 1 wherein said primary stone girdles are engaged by said aperture wall segments.

3. The article of jewelry of claim 1 wherein each said stone is a round stone.

4. The article of jewelry of claim 1 wherein each said accent stone receiving socket has a semi-cylindrical sidewall.

5. The article of jewelry of claim 4 wherein each said semi-cylindrical sidewall includes an accent stone protecting lip.

6. The article of jewelry of claim 1 wherein each said post includes an accent stone girdle receiving bearing.

7. The article of jewelry of claim 1 further including a metal coating on said segmented slot webs.

8. The article of jewelry of claim 1 wherein said article body is a ring.

9. The article of jewelry of claim 8 wherein said segmented slot extends circumferentially in said ring.

10. The article of jewelry of claim 9 wherein said accent stone receiving sockets are located in said body of said ring and are adjacent to said circumferentially extending segmented slot.

11. The article of jewelry of claim 8 wherein said ring includes spaced side walls.

12. The article of jewelry of claim 11 wherein each said accent stone receiving socket includes a cylindrical outer socket wall defining a portion of one of said ring body side walls.

13. The article of jewelry of claim 1 wherein each of said posts includes a post top and further wherein each of said accent stone includes a table, said tables being positioned in said body below a level of said tops of said posts.

14. The article of jewelry of claim 1 wherein each said accent stone receiving socket has an open socket bottom.

15. An article of jewelry comprising:

a jewelry article body;

a segmented slot formed in said body and including spaced slot apertures, including arcuate aperture wall segments with aperture wall segment grooves, and slot webs;

a plurality of spaced posts bounding said segmented slot and extending above said slot aperture wall segments;

a plurality of primary stones positioned in said segmented slot in a linear setting;

a plurality of accent stone receiving sockets in said body intermediate said posts; and an accent stone in each said accent stone receiving socket and in engagement with said one of said spaced posts bounding each said accent socket.

16. The article of jewelry of claim 15 further including girdles on said primary stones and on said accent stones, said primary stone girdles being engaged by said aperture wall segments.

17. The article of jewelry of claim 15 wherein each said accent stone receiving socket has a semi-cylindrical sidewall.

18. The article of jewelry of claim 17 wherein each said semi-cylindrical sidewall includes an accent stone protecting lip.

19. The article of jewelry of claim 15 wherein each said post includes an accent stone girdle receiving bearing.

20. The article of jewelry of claim 15 wherein each of said posts includes a post top and further wherein each of said accent stone includes a table, said tables being positioned in said body below a level of said tops of said posts.

* * * * *